US005136758A

United States Patent [19]

Wilcox et al.

[11] Patent Number: 5,136,758

[45] Date of Patent: Aug. 11, 1992

[54] ZIPPER ATTACHMENT DEVICE

[76] Inventors: James J. Wilcox, P.O. Box 309, Oldwick, N.J. 08858; Richard D. McFadden, P.O. Box 363, New Gretna, N.J. 08224; Robert L. Tuchman, 1 Vultee Dr., Florham Park, N.J. 07932

[21] Appl. No.: 542,890

[22] Filed: Jun. 25, 1990

[51] Int. Cl.[5] ..... A44B 19/26

[52] U.S. Cl. ..... 24/431; 24/429; 24/49 S; 24/16 PB

[58] Field of Search ..... 24/431, 429, 437, 419, 24/16 PB, 17 AP, 30.5 P, 11 S, 49 S

[56] References Cited

U.S. PATENT DOCUMENTS

| | | | |
|---|---|---|---|
| 2,221,759 | 11/1940 | Erard | 24/431 |
| 3,583,044 | 6/1971 | Howell | 24/431 |
| 3,719,973 | 3/1973 | Bell | 24/429 |
| 3,779,494 | 12/1973 | Nicholson et al. | 24/16 PB |
| 3,855,669 | 12/1974 | Meyer | 24/16 PB |
| 4,035,873 | 7/1977 | Epperson | 24/49 P |
| 4,135,272 | 1/1979 | Stephenson | 24/16 PB |
| 4,516,293 | 5/1985 | Beran | 24/17 AP |
| 4,617,702 | 10/1986 | Diederich, Jr. | 24/16 PB |

FOREIGN PATENT DOCUMENTS

| | | | |
|---|---|---|---|
| 8002494 | 11/1980 | European Pat. Off. | 24/429 |
| 1531615 | 7/1968 | France | 24/431 |

*Primary Examiner*—Victor N. Sakran
*Attorney, Agent, or Firm*—Kenneth P. Glynn

[57] ABSTRACT

The present invention is directed to a device that suspends decorative designs, logos or jewelry from zipper apertures. The device consists of a band that has ridges along its surface and a slide that is adjustable along the band. The slide has attachment means for selectively engaging the ridges of the band, thus locking the slide into place. The band is placed through a zipper aperture, until a stop at the end of the band comes to rest against the aperture. The resulting portion of the band being suspended from the zipper aperture may be passed through the slide, and the slide may then be arbitrarily locked into position by the attachment means. The slide contains a decorative design that can be either two or three dimensional. The suspended slide can be easily unlocked from the band and readjusted or removed without harming the band or the slide. Once removed, the decorative design-containing slide can be replaced with any other slide with other designs. When a decorative design slide is attached to the band, the band is secured to the zipper aperture by the band stop on one side of the aperture and the decorative design slide on the other. The suspended design slide may optionally be used to functionally assist the operation of the zipper by pulling on the suspended design rather than on the zipper itself.

8 Claims, 5 Drawing Sheets

1
3
5
7
9
11
13
21
23
25
27
29
31
33

ZIPPER ATTACHMENT DEVICE

BACKGROUND OF THE INVENTION

1. Field of the Invention

The present invention is directed toward a zipper attachment device, and more particularly to such devices that permit a user to selectively suspend, remove and interchange differing decorative designs, logos or jewelry from the apertures of zippers to both add to the operation of the zipper and add to its aesthetic value.

2, Prior Art Statement

Over the years, zipper apertures have played host to a variety of suspended articles. Traditionally such devices were made of cloth or leather, to assist in the operation of the zipper, or of string or plastic, to suspend informational information about the zippered item. The traditional cloth and leather attachments are tied to zippers, through their apertures, and extend a length downward to assist a user in gripping and operating the zipper. Such extensions may have items attached to their ends, but such attachments are usually sewn or tied to the end and are not easily exchanged or removed.

Traditional informational zipper attachments are usually made from a thin strand of plastic or string and serve as mediums to suspend printed information such as price tags, warranties, manufacturer identification and the like. These attachments have no functional value to the zipper and are suspended from the zipper solely as not to damage the material of the zippered item. As such, the informational attachments on zippers are made to be easily removed, and once removed not reattachable to the zipper aperture.

There exists no prior art concerning devices, such as the present invention, for selectively suspending decorative designs and logos from zipper apertures. The present invention can suspend a design from a zipper and lock it into place, to assist in the operation of the zipper, however the invention allows the suspended design to be repeatedly adjusted, removed and replaced without harming the suspended design or the suspension medium. The changing of the suspended design is quick and easy and does not require untying or other complicated manipulations of traditional means. Additionally, the present invention provides for an attachment of a zipper extension that not only assists in the operation of the zipper, but lets the operator change the aesthetics of the zipper extension at will.

Thus, prior art does show the use of zipper apertures to suspend functional or informational items, but prior art does not show a zipper suspension device that allows for the quick and easy interchanging of decorative designs, that are reusable, adjustable, have aesthetic value and serve to functionally assist a zipper's operation.

SUMMARY OF THE INVENTION

The present invention is directed to a device that suspends decorative designs, logos or jewelry from zipper apertures. The device consists of a band that has ridges along its surface and a slide that is adjustable along the band. The slide has attachment means for selectively engaging the ridges of the band, thus locking the slide into place. The band is placed through a zipper aperture, until a stop at the end of the band comes to rest against the aperture. The resulting portion of the band being suspended from the zipper aperture may be passed through the slide, and the slide may then be arbitrarily locked into position by the attachment means. The slide contains a decorative design that can be either two or three dimensional. The suspended slide can be easily unlocked from the band and readjusted or removed without harming the band or the slide. Once removed the decorative design-containing slide can be replaced with any other design, logo or jewelry that encompasses a slide. When a decorative design slide is attached to the band, the band is secured to the zipper aperture by the band stop on one side of the aperture and the decorative design slide on the other. The suspended design slide may optionally be used to functionally assist the operation of the zipper by pulling on the suspended design rather than on the zipper itself.

BRIEF DESCRIPTION OF THE DRAWINGS

The present invention will be more fully appreciated when the present specification is taken in conjunction with the appended drawings, wherein.

Figure 10:
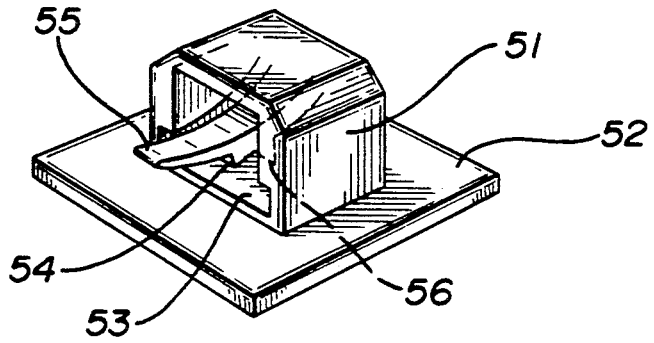
Figure 11:
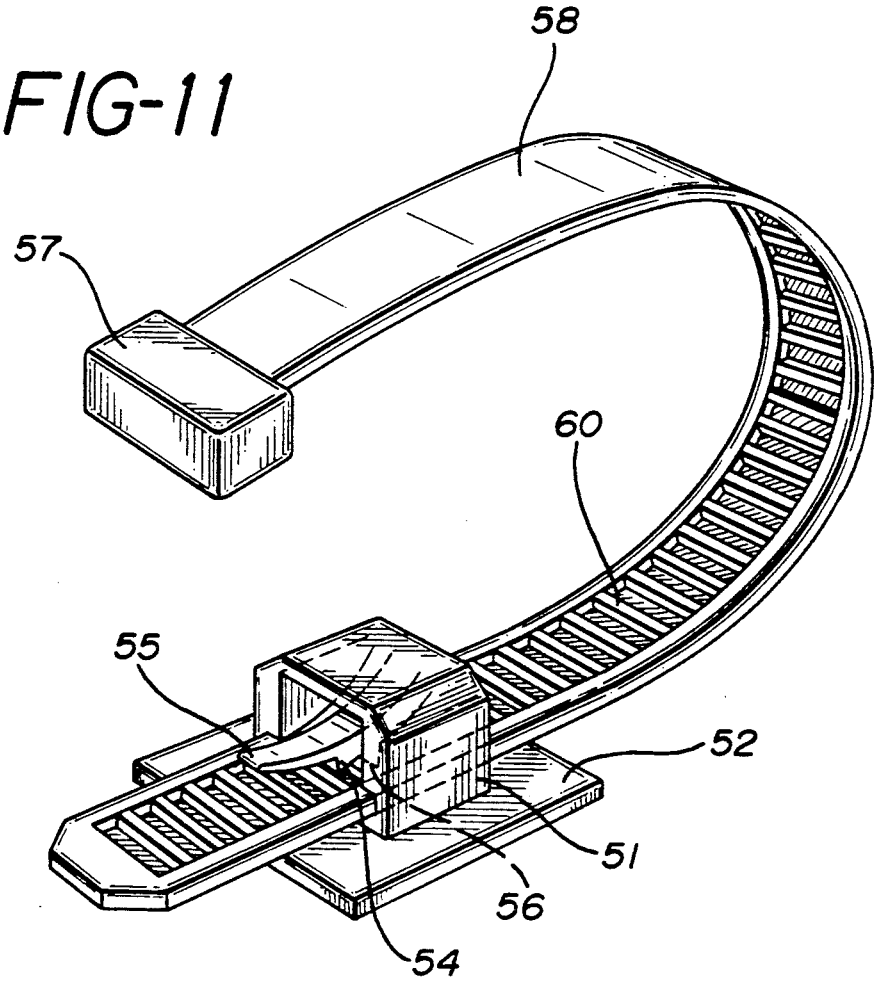
Figure 12:
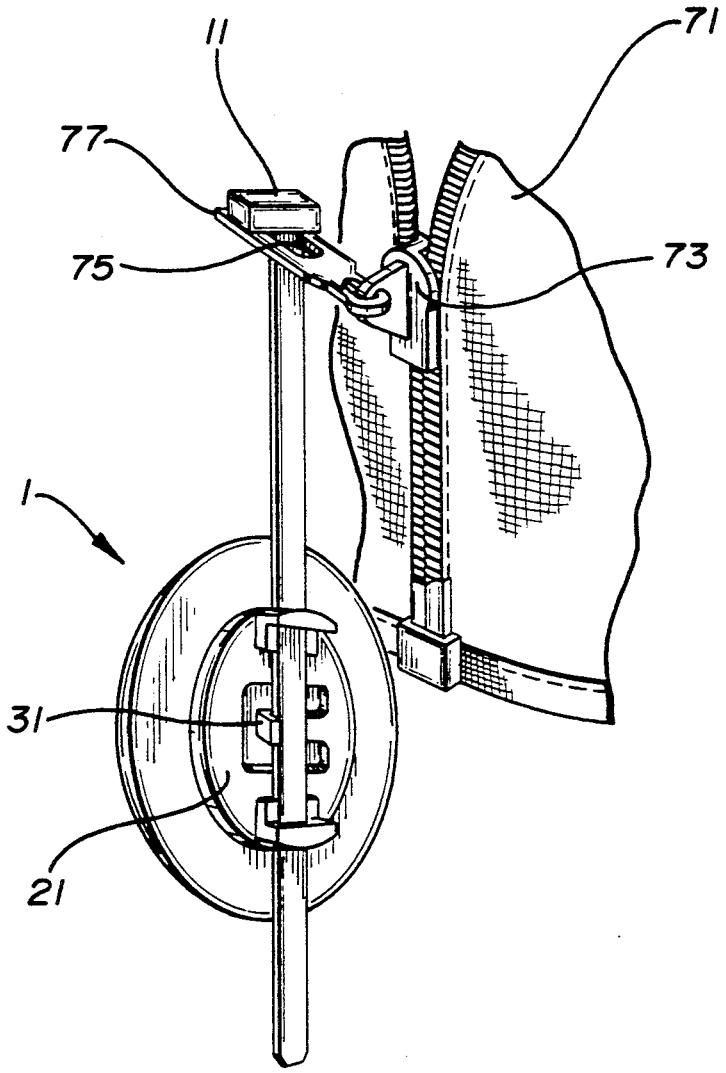

FIGS, 7, 8 and 9 respectively show a back view, a side view and an oblique rear view of a present invention slide used in a device of the present invention;

FIG. 10 and FIG. 11 show an oblique side view of an alternative attachment means for a slide of the present invention; and, FIG. 12 shows an oblique rear view of a present invention device attached to a zipper.

DETAILED DESCRIPTION OF THE INVENTION

The present invention is, as mentioned, directed towards a device for suspending decorative designs, logos or jewelry from zipper apertures. In the past, a large variety of items, from price tags to ski lift tickets, have been suspended from zipper apertures. Zipper apertures are commonly used to suspend items, because such apertures are usually the only place on a piece of clothing that invites attachment without harming the integrity of the fabric. Historically, the items suspended from zipper, apertures have come in two forms, functional and informational. Functional zipper suspensions are usually made of cloth or leather and are tied through the zipper aperture. This material extending from the zipper aperture is then used to assist in the functional operation of the zipper. Such extensions are needed to work small zippers or zippers that are hard to reach. Additionally, such extensions are common on children's clothes to help a child's small hand and on older persons' clothes who have joint trouble gripping zippers. Many such functional extensions are color coordinated with the fabric associated with the zipper, and are as unobtrusive as possible, so as not to offend the wide variety of tastes in the consuming public. For this reason decorative designs attached to the ends of extensions are rare, but when they do exist they are either sewn, tied or otherwise permanently attached to the zipper extension and are not readily removed. If the buyer of an item does not like the zipper extensions, the only portion available is to remove them, by untying or cutting the extension from the zipper.

As for informational zipper aperture extensions, these exist on many new consumer goods having zippers. Such information, usually suspended from the zipper apertures, include the price tag, manufacturer brand name, warrantee information and the like. Such information is usually suspended from the zipper aperture by a string or a thin strand of plastic, and has no functional utility other than to suspend information for the consumer. Such zipper aperture extensions are usually removed by the consumer soon after purchase, and once removed they cannot be reattached.

The present invention adds to the science of zipper aperture suspension. The present invention consists of a band and a slide, with a decorative design being affixed to the slide. The band has a stop at one end and a plurality of ridges on at least one of its surfaces. The band is placed through a zipper aperture until the band stop comes into contact with the zipper aperture surface. As a result, the length of the band is suspended from the zipper. The suspended band is placed within a slide attachment means that can selectively engage the ridges along the band, locking the slide into place. Once locked into place, the present invention is securely affixed to the zipper aperture by the band being placed through the aperture and secured on the side by the band stop and on its other side by the decorative design-containing slide. The slide can be easily disengaged from the band and either removed from the band or repositioned along the band. The application, readjustment and removal of the slide to the band can be repeated indefinitely without causing damage to either band or slide and a plurality of slides may readily be removed.

As mentioned, the slide has a decorative design, jewelry or logo affixed to its front and thus allows such a design to be suspended from the zipper. The attachment of a design to a zipper in this manner has many advantages. With the present invention, three-dimensional designs can be easily and quickly affixed to any zipper aperture. Since a person's moods and tastes change with time, the old design can easily be replaced with a new design or a new design can be added to the old design without effort. In situations where small zippers exist, or where zippers are in hard to reach places, the present invention can be used in place of traditional leather or cloth zipper extensions, to customize and personalize the zippered item. On children's clothing, three dimensional items such as small toys or plastic cartoon characters can be attached to zippers. The large gripping area will help a child's small hand operate a zipper and will provide novelty to the child. Also, the easy removal of the present invention will allow parents to readily remove the zipper extensions during inappropriate situations such as for dry cleaning. Additionally, the band used in suspending a top from a zipper can be used to activate the toy, such as a toy car that is activated by pulling a grooved band through a spring loadable, gear drive mechanism.

In place of informational zipper aperture attachments, the present invention can be used to attach three-dimensional trademarks to clothing to identify the manufacturer. Also, the present invention provides a means for a retailer to inexpensively attach, remove and reuse items such as "on sale" tags or security devices for consumer goods. In situations where the same item is often removed and reattached to clothing such as pool passes, beach tags, security passes, ski passes, club memberships and the like, the present invention allows the user to attach the items without damaging their clothing. When removed, the present invention preserves the integrity of the attached item and its means of attachment so that it can be reused indefinitely.

For all of the above reasons, the present invention greatly increases the versatility and range of the items that can be attached to zipper apertures with the ability of those items to be removed, interchanged, or adjusted with minimal effort while still functionally adding to the operation of the zipper.

Figures 1, 2, 3:
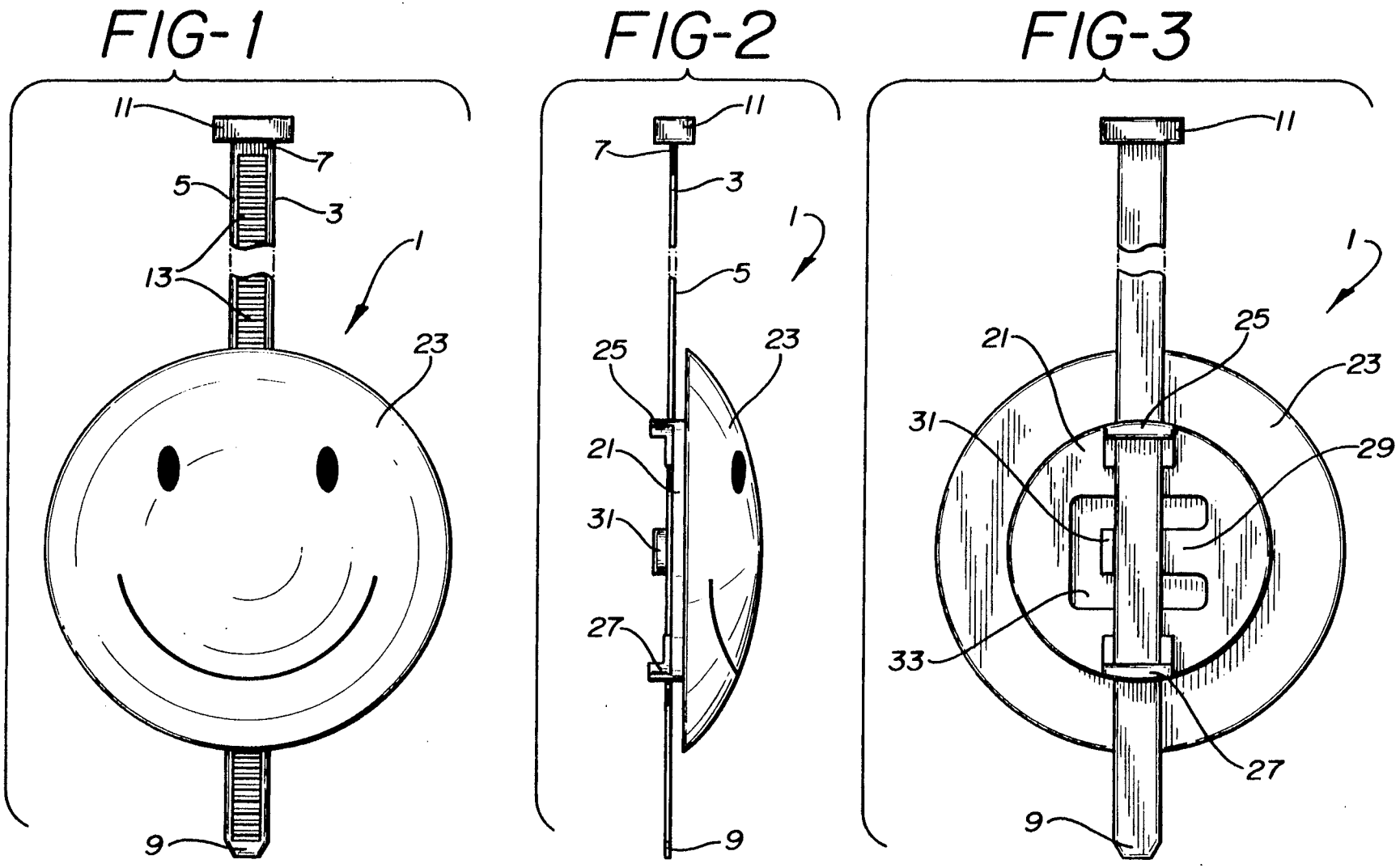
FIG. 1 shows a front view.
FIG. 2 shows a side view and FIG. 3 shows a back view of a present invention device for suspending objects from small apertures.

Referring now to FIG. 1, and FIG. 2 and FIG. 3, there is shown a front, side and back view of a present invention device shown generally as Device 1. Band 3 includes a front 5 and a back (not shown) and two ends, in this case top end 7 and bottom end 9. Top end 7 includes an enlarged stop 11 and front side 5 contains a plurality of ridges 13 contained thereon. Slide 21 includes a three dimensional design 23, in this case a happy face, as well as a three part attachment means which includes yokes 25 and 27 and tension member 29 which includes press 31 and recess 33.

Figure 4:
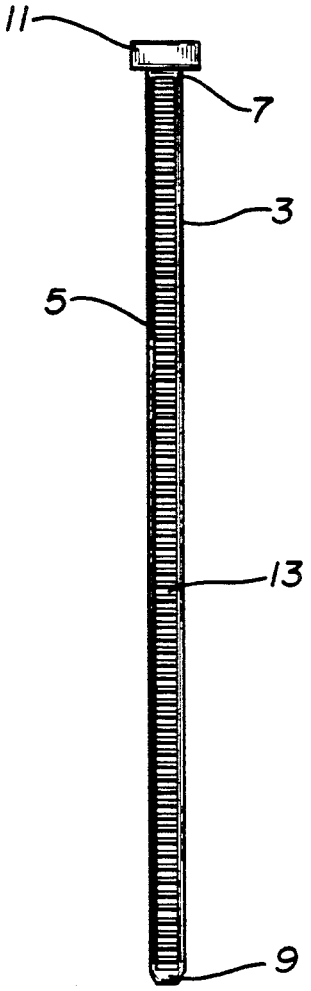
FIG. 4 shows a front view.
Figure 5:
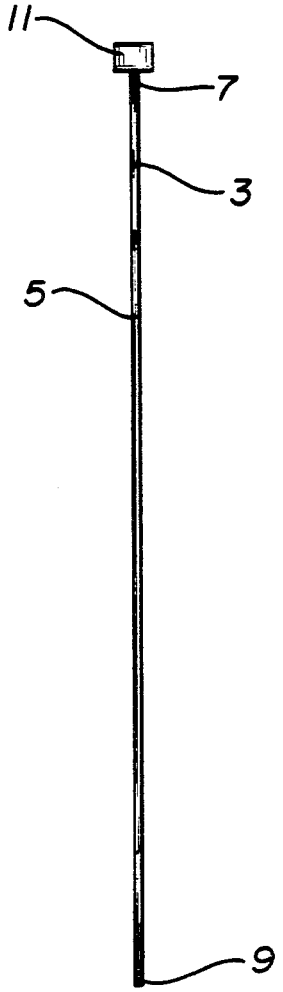
FIG. 5 shows a side view and FIG. 6 shows an oblique view of a band used in a present invention device.
Figure 6:
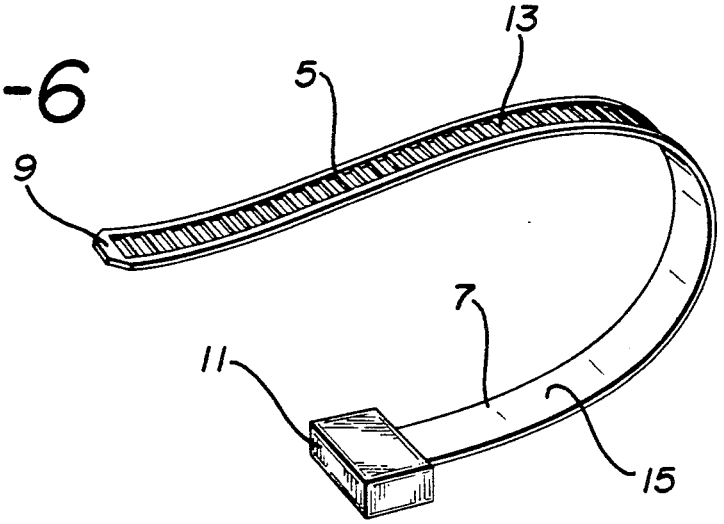

FIGS. 4, 5 and 6 show greater detail of slide 3 and parts which are identical to those shown in FIGS. 1 through 3 are identically numbered. As can be seen, band three is flexible and has a slightly tapered bottom end 9. While in this embodiment, the backside 15 is smooth, it could contain ridges such as ridges 13 shown on front side 5 either along with those shown on front side 5 or in the alternative.

Figure 7:
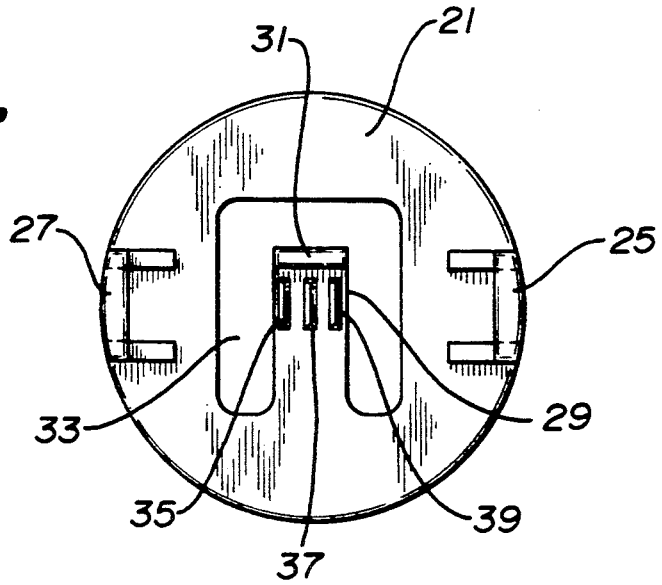
Figure 8:
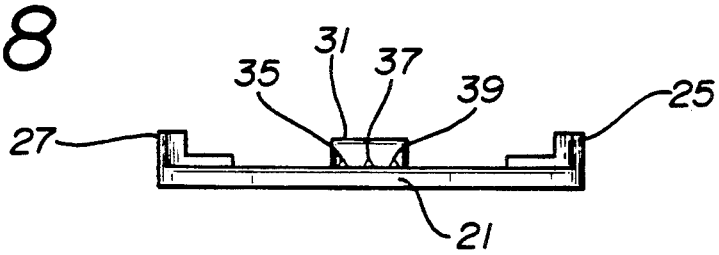
Figure 9:
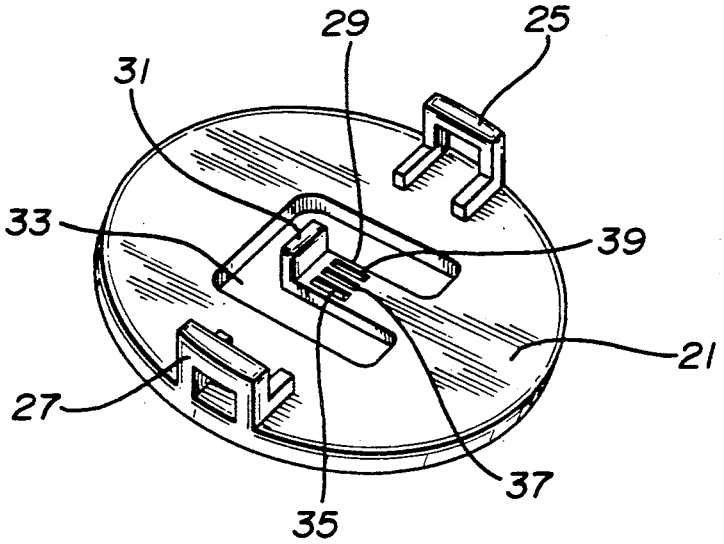

FIG. 7 shows a back view of slide 21 and FIG. 8 shows a side view thereof while FIG. 9 shows an oblique rear view thereof. Note the details of yoke 25 and yoke 27 as well as tension member 29. Press 31 may be pressed to push tension member 29 downwardly for disengagement of a band such as band 3 with the ridges of such a band being intimately engaged and disengaged by ridges such as ridges 35, 37 and 39 shown in these figures. Recess 33 permits the depression of tension member 29 and has adequate clearance under tension member 29 so as to disengage with a band upon depression thereof. The spring like tension member 29 recovers to its original position when released so as to engage the ridges of the band for locking slide 21 thereon.

FIG. 10 and FIG. 11 show an alternative attachment means 51 located on a portion of a slide 52. The alternative attachment 51 has an elastic ratchet pawl 55 extending obliquely downwardly therefrom. The elastic pawl has two angled stops 54 and 56 on its lower surface that selectively engage the ridged grooves 60 embossed onto one side of the band 58. The alternate attachment 51 engages the band 58 by placing the band 58 through the alternative attachment orifice 53. The orifice 53 is cleared by pulling the elastic pawl 55 up and away from the band ridges 60. Once the desired amount of the band 58 is passed through the alternative attachment 51 the elastic pawl 55 is released and the slide 52 is subsequently locked in position by the engagement of the pawl ridges 56 and 54 with the band ridges 60. One attachment means may be utilized exceeding the scope of the invention. For example, a hinged snap or other type of buckling device may be used or a tension strap or an elastic attachment could be used. Other types of attachments should now be within the purview of the artisan.

FIG. 12 shows present invention device 1 attached to an article of clothing 71 at its zipper 73. More specifically, the aperture 75 of zipper tab 77 from zipper 73 has band 3 pass therethrough with enlarged stop 11 located at the aperture or opening 75. As can now be seen, the slide 21 may be moved up and down or taken off by depression of button 31 so as to change slides or so as to add additional slides to band 3.

Obviously, numerous modifications and variations of the present invention are possible in light of the above teachings. It is therefore understood that within the scope of the appended claims, the invention may be practiced otherwise than as specifically described herein.

What is claimed is:

1. A device for suspending objects from small apertures, which comprises, in combination:

(a) a band having at least two side surfaces, a top end and a bottom end, with at least one side of said two side surfaces having a plurality of ridges formed thereon, and said top end terminating in an enlarged stop unable to pass through said small aperture;

(b) a slide having a front surface and a back surface, said back surface having a plurality of yokes linearly aligned thereon, for the passage of said bottom end of said band therethrough, and at least one tension member positioned between any two said aligned yokes, said tension member engaging said band as said band transgresses the length between said adjacent yokes, the contact of said band with said plurality of yokes and said tension member inhibiting the movement of said slide along said band; and (c) a formed object of aesthetic value being permanently affixed to said front surfaces of said slide.

2. The device of claim 1 wherein the engagement of said band with said tension member, as said band trangresses the length between two said yokes, causes said tension member to elastically deform from its normal orientation, said tension member thus being spring biased against said band, stressing said band between said yokes and inhibiting the movement of said slide along said band.

3. The device of claim 2 wherein said tension member has a plurality of protrusions formed thereon, said protrusions positively engaging said ridges formed on said band, preventing the linear movement of said band in relation to said slide.

4. The device of claim 3 wherein said tension member terminates at one end with a formed finger press, the downward application of force to said press by a user causing said tension member protrusion to disengage said ridges on said band, allowing said band to move linearly through said slide.

5. The device of claim 4 wherein said slide with said plurality of yokes and said tension member are unistructurally formed from the same material.

6. A device for suspending objects from small apertures, which comprises in combination:

(a) a band having at least two side surfaces, a top end and a bottom end, with at least one side of said two side surfaces having a plurality of ridges formed thereon, and said top end terminating in an enlarged stop unable to pass through said small aperture;

(b) a slide having a front surface and a back surface, said back surface having an attachment means thereon, said attachment means having an orifice formed therethrough for the passage of said band, wherein said orifice has an elastic ratchet pawl extending downwardly therein, said elastic pawl having at least one angled stop protruding downwardly therfrom, the passage of said band into said orifice causing said ratchet pawl to elastically deform from its instressed orientation, the deformation of said ratchet pawl causing said ratchet pawl to be spring biased against said angled stop to engage said ridges formed on said band, inhibiting said band to move independently of said slide; and (c) a formed object of aesthetic value being permanently affixed to said front surface of said slide.

7. The device of claim 6 wherein one end of said elastic pawl ratchet extends through said orifice, allowing said elastic pawl ratchet to be manually deformed by a user to a point where said elastic pawl ratchet no longer engages said band.

8. The device of claim 6 wherein said elastic pawl has two angled stops protruding downwardly therefrom, each said angled stop engaging said ridges formed on said band, inhibiting the movement of said slide along said band in any direction.

* * * * *